US005086211A

United States Patent [19]

Schreder

[11] Patent Number: 5,086,211

[45] Date of Patent: Feb. 4, 1992

[54] ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 671,527

[22] Filed: Mar. 19, 1991

[30] Foreign Application Priority Data

Mar. 20, 1990 [DE] Fed. Rep. of Germany ..... 4008830

[51] Int. Cl.[5] ..... H05B 3/70

[52] U.S. Cl. ..... 219/451; 219/459

[58] Field of Search ..... 219/451, 458, 459, 464

[56] References Cited

U.S. PATENT DOCUMENTS

| | | | |
|---|---|---|---|
| 2,261,496 | 11/1938 | Happe et al. . | |
| 3,246,123 | 4/1966 | Ammerman | 219/451 |
| 4,658,118 | 4/1987 | Kicherer | 219/451 |
| 4,766,290 | 8/1988 | Schreder | 219/451 |
| 4,871,902 | 10/1989 | Kicherer | 219/458 |

FOREIGN PATENT DOCUMENTS

| | | |
|---|---|---|
| 0113923 | 12/1983 | European Pat. Off. . |
| 0307630 | 8/1988 | European Pat. Off. . |
| 1021967 | 1/1958 | Fed. Rep. of Germany . |
| 2442717 | 3/1976 | Fed. Rep. of Germany . |
| 2651848 | 5/1978 | Fed. Rep. of Germany . |
| 3027998 | 2/1982 | Fed. Rep. of Germany . |
| 3519035 | 11/1986 | Fed. Rep. of Germany . |
| 8712088 | 10/1987 | Fed. Rep. of Germany . |
| 3803806 | 8/1989 | Fed. Rep. of Germany . |
| 2194720 | 3/1988 | United Kingdom . |

*Primary Examiner*—Teresa J. Walberg
*Attorney, Agent, or Firm*—Eckert Seamans Cherin & Mellott

[57] ABSTRACT

To a lower coverplate of an electric hotplate a side plate is fitted, onto which can subsequently be mounted an insulator by means of a locking connection. The insulator receives connecting leads from the hotplate and corresponding connections, such as flat connecting tongues. As a result of the subsequent mountability of the insulator, the transportation height is reduced, and by a desired bending point, the entire connecting unit can easily be adapted to different installation shapes and heights.

16 Claims, 3 Drawing Sheets

Fig. 4
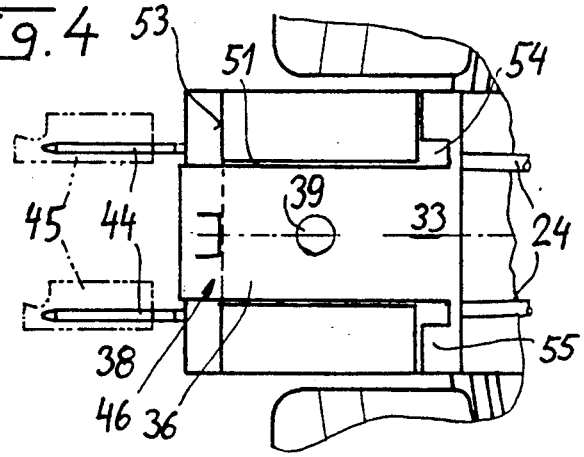
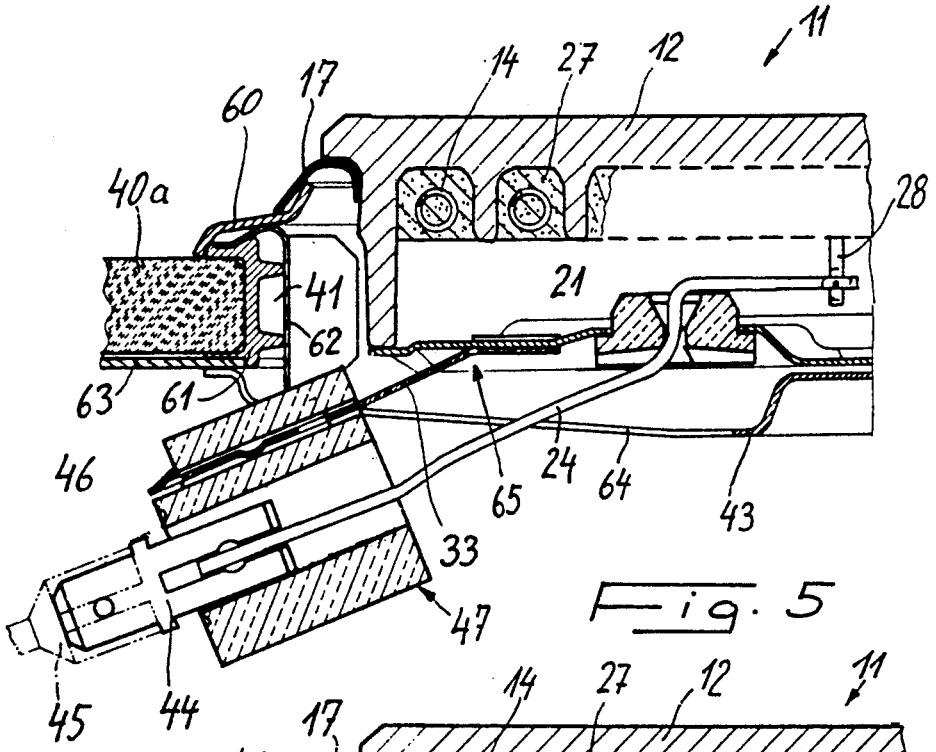
Fig. 5
Fig. 6
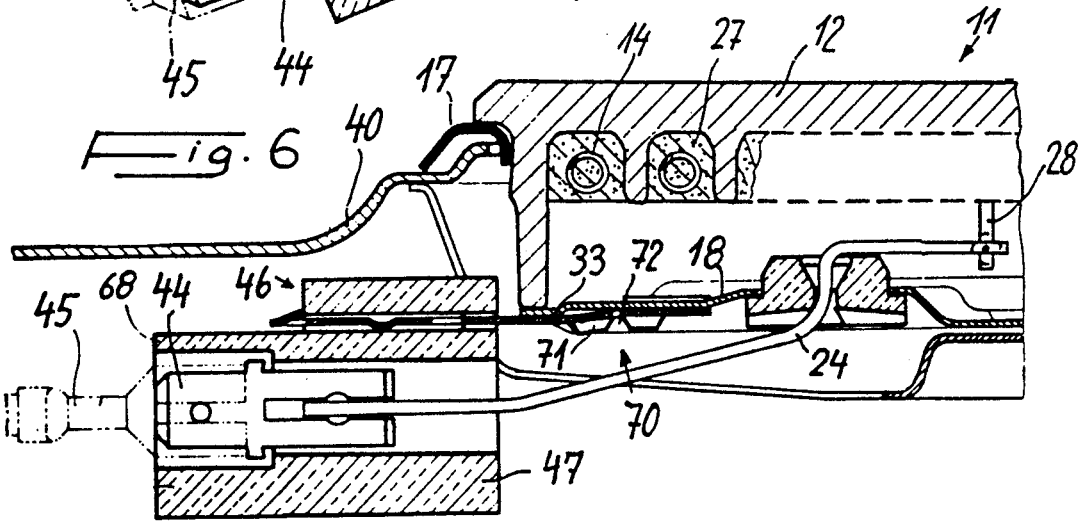

11
14
27
12
28
40
46
44
68a
33
21
24
47
78
77
79
73
48
45a
75
76
74
60
40a
38
70
80
66a

ELECTRIC HOTPLATE

The invention relates to an electric hotplate.

BACKGROUND OF THE INVENTION

DE-B-10 21 967 discloses an electric hotplate, on whose lower cover is placed a connecting member in the form of a sheet-metal holder, which projects substantially horizontally and radially with respect to the hotplate over the marginal termination thereof and to whose end is fixed an insulator. It contains screw terminals for connecting leads, which pass through the cover into the electric hotplate. Millions of this construction have been manufactured and proved satisfactory, but it still leads to problems during the transportation and handling of the hotplate between the manufacturer and the assembler and requires differentiated storage, because with each connection system must be associated one particular hotplate type.

DE-A-38 03 806 discloses an electric hotplate, which has no such connecting parts. The insulator therein is merely held by the solid connecting leads and is supported with a step on the hotplate rim. Plug connections and screw connections can be used. This system has the advantage that the hotplate can be stacked in a much more space-saving and stack-secure manner during transportation, because there is no need for the laterally and downwardly projecting insulator to be present. It can be mounted subsequently and the leads can be bent from their position originally located in the hotplate plane into the use position.

The problem of the present invention is to further improve the aforementioned prior art and in particular whilst retaining the advantages of reduced stacking volume, to further improve the electrical appropriateness and mechanical safety.

SUMMARY OF THE INVENTION

Due to the fact that the connecting part, e.g. a metal sheet fixed to the hotplate cover by one side, can be connected by a high-speed connection to the insulator, it is not necessary to fixedly instal the insulator at the time of hotplate manufacture. During transportation the connecting part and the connecting leads can be bent downwards into the hotplate plane and the insulator can subsequently be snapped onto the connecting part, the leads preferably projecting into and through openings of the insulator or are provided there with plug or screw connections.

According to a further feature the connecting part can be so fitted to the hotplate that it can be pivoted or swung in one direction, e.g. through a predetermined bending point in the metal sheet. However, the pivoting is limited to a downward movement about an axis closer to the hotplate center, whilst in the lateral direction the metal sheet prevents pivoting or swinging motions. As a result it is ensured that after mounting the insulator lateral forces, which act on the hotplate and attempt to twist it with respect to its normal position cannot lead to contacting taking place between the uninsulated leads or with the hotplate. They remain parallel and in the intended orientation. It also ensures that the leads with the insulator cannot be pivoted too far downwards when the electric hotplate is in the installed position and thereby come into contact with other parts.

However, it is advantageous if pivoting in a specific angular range, e.g. up to 45° (preferably up to 30°) is possible, so that under specific installation conditions the insulator with the connecting part and the leads can slope downwards.

In order to also fix this position, a pivoting limitation can be provided, which comes into action after the desired angle and stiffens the metal sheet in this position. It can be constructed in conjunction with stiffening corrugations, e.g. by a sheet metal flap drawn in sloping manner out of the connecting part plane and which is reinforced by corrugations and on bending down engages on the connecting part or the hotplate cover, so that in this position the pivoting or bending is blocked about the desired bending point.

During such a pivoting the leads which run below the connecting part and therefore together with the insulator form a flat triangle, can slide longitudinally into the insulator openings, which causes no problem in the case of plug connections because the lugs can be welded to the leads and the openings merely have a lateral guidance function and are not used for the longitudinal fixing of the said lugs. On the same can then be engaged corresponding pin bushings of the supply lines.

In the case of the also possible screw connections, the latter can be provided in the insulator. As the screwing of the leads in the screw connections only take place following the orientation of the connecting part in the correct angular position, here again the existing length difference causes no problems, because the leads are longitudinally displaced in the screw terminal and are subsequently fixed in the correct position. In the then assumed position with this construction the insulator is then fixed by a static triangle. The high-speed coupling between the connecting part and the insulator and the pivotability of the connecting part can in each case individually advantageously solve the problem of the invention. However, a particularly advantageous embodiment is provided if both features are adopted.

BRIEF DESCRIPTION OF THE DRAWINGS

In the drawings show:

FIG. 4 A section through the insulator.

FIG. 5 A section through the same hotplate installed in a different hob.

FIGS. 6 and 7 Views corresponding to FIG. 2 of hotplates with plug connections.

FIG. 8 A view from below of FIG. 7.

FIGS. 9 and 10 Representations corresponding to FIGS. 2 and 4 of a hotplate with screw connections.

FIGS. 11 and 12 A hotplate and its connecting part in vertical section and a view from below.

DESCRIPTION OF THE PREFERRED EMBODIMENTS

Figure 1:
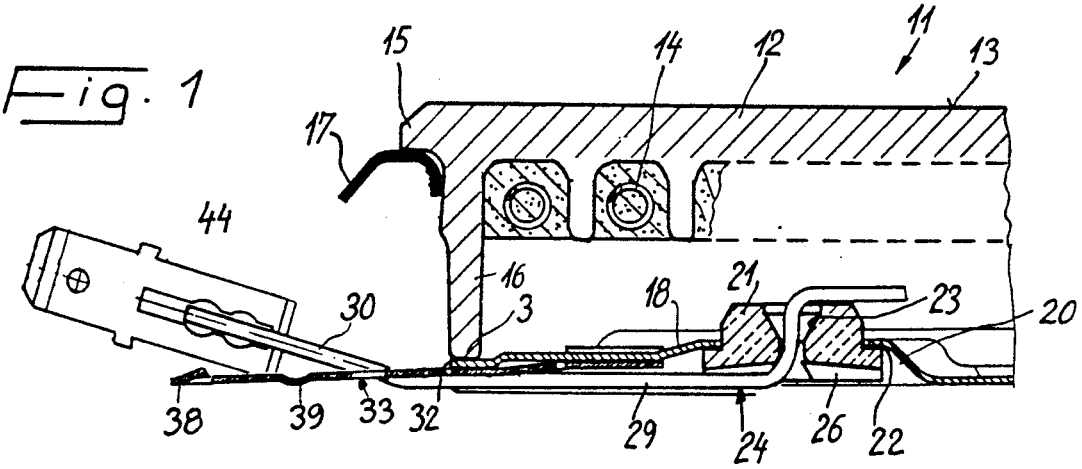
FIG. 1 A diagrammatic partial section through an electric hotplate in the state adopted for transportation.

FIG. 1 shows an electric hotplate 11 with a cast material hotplate body 12, which has an upper, substantially planar cooking surface 13 and an electric heating means 14 embedded in a ceramic material below the same. The circular hotplate has on its outer circumference a projecting flange 15 and a downwardly directed, substantially cylindrical rim 16 on its outer circumference and, supported on the underside of the flange 15, is pressed a support ring 17, which serves as a trim ring.

On the lower edge of the rim 16 is supported a hotplate cover 18, which is formed from a metal sheet, which is fixed to the hotplate body, in that it is e.g. fixed by a bolt screwed into the centre stud of the hotplate. However, fixing by other means is also possible, such as e.g. snap connections or barb-like claw systems, as well as screws on an edge or rim of an unheated central zone.

A bushing 25 is provided in an opening 19 in a portion 20 of the cover 18, which is slightly depressed compared with the hotplate body and which is supported by a shoulder 22 in external manner on the cover and has holes 23 through which project the connecting leads 24. The bushing 21 can be inserted from the outside in the opening 19, for which purpose it has guide facets and is guided with a cylindrical part, connected to the shoulder 22 in the opening. It can be fixed there by a clamping action and/or by wrapping round a correspondingly constructed tab 25 (cf. FIG. 3). From the holes 23 grooves 26, which are radial to the hotplate extend to the outside (and optionally to the inside) whilst providing a certain guidance for the leads 24 if the latter are subsequently bent round at the holes.

The inner ends of the leads (two in the example shown) are welded with terminal pins 28 projecting out of the insulating material 27 covering the heating means 14. They pass horizontally to the holes, travel vertically or in sloping manner therethrough and are then bent away roughly horizontally and radially.

FIG. 1 shows the hotplate in the state following its manufacture and during its transportation. The leads 24 are so placed in the portion 29 connected to the bushing and in its outwardly directed end portion 30, which is connected thereto under a certain angular deflection in the upwards direction, that they are substantially parallel to the underside of the hotplate and scarcely increase the stack height. They can even be upwardly bent under an angle.

Between the bushing 21 and the rim 32 of the cover 18 resting on the underside 31 of the rim 16 of the hotplate body 12 is fixed a sideplate 33 also designated as a connecting means. As can be gathered from FIG. 3, in a view from below it has an offset T-shape. The inner T-beam 34 is bent down at its ends, passed through slots 35 in the cover 18 and fixed thereto by bending round. The centre leg connected to the T-beam 34 firstly has a wider portion 37 and ends in a narrower portion 36. Close to its end a barb-like acting tongue 38 is bent out of the resilient sheet metal material. A central boss 39 is embossed. The portion 36 is so narrow that the leads with the flat connecting tongues 44 welded thereto pass by in the lateral direction.

Figure 2:
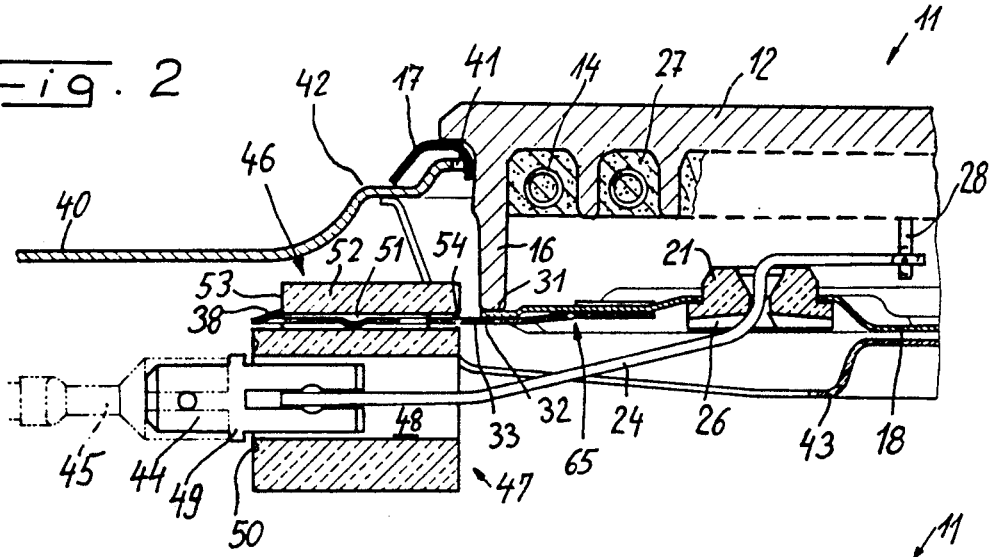
FIG. 2 A vertical partial section through an electric hotplate in the fitted state.
Figure 3:
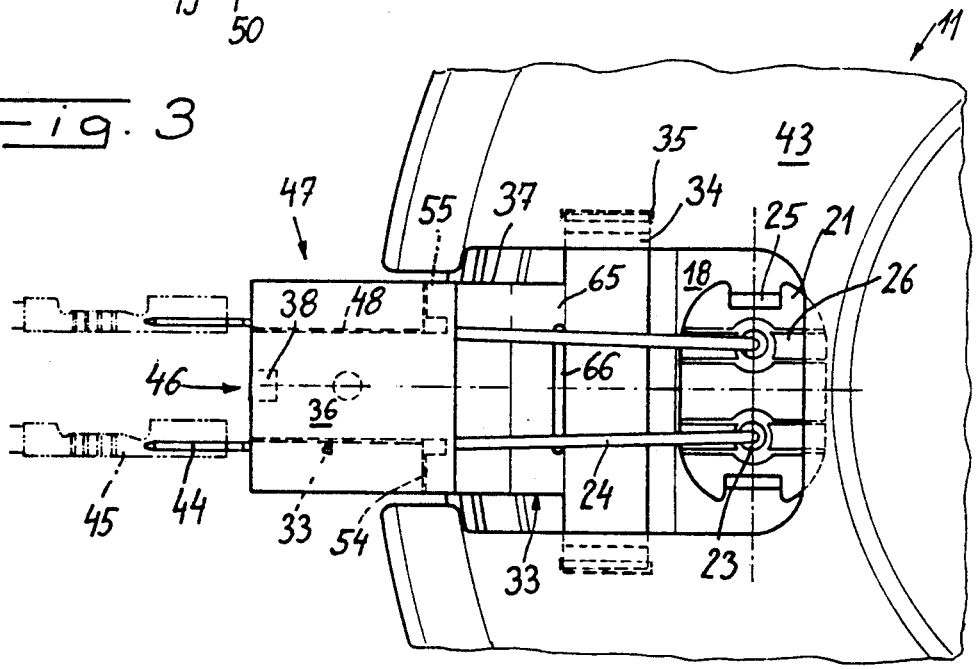
FIG. 3 A view from below of the part shown in FIG. 2.

FIGS. 2 and 3 show the installed state, in which the hotplate 11 is inserted in an opening 41 in a trim plate 40, which can be the upper plate of a hob or a hotplate. It comprises enamelled or stainless steel sheeting and has a stepped, upwardly directed stamping 42, on whose step is also supported the support ring 17 under the action of a not shown centre bolt, which engages on a clamp 43.

During hotplate manufacture flat connecting tongues 44, which can cooperate with corresponding plugs 45, are welded to the front portion 30 of the leads 24.

An insulator 47 can be connected by means of a high-speed connection 46 to the sideplate 33 and forms passage openings 48 for the leads 24 and the flat connecting tongues 44 connected thereto and guides and maintains the same in the correct position and reciprocal spacing. The tongues 44 have lateral projections 49, which have a size which is only slightly smaller than the inside dimension of the passage openings 48 and are somewhat bevelled on the inside, so that they will be laterally displaced with corresponding facets 50 on the insulator, even in the case when an attempt was made to draw them back through the passage openings, this being possible as a result of the smaller dimensions of the part of the flat connecting tongues projecting into the openings 48. More particularly taking account of the relatively stiff leads, they are consequently secured in the insulator, but have a certain axial freedom therein.

The insulator is a substantially rectangular body, which has on its top surface a narrow passage slot 51 in a length-shortened area 52. The strip-like portion 36 can be passed through this slot and then locks with the tongue 38, which is supported on the face 53 of the portion 52. The boss 39 is supported on the underside in the passage slot 51, so that the sheet metal portion remaining between it and the tongue 38 has the necessary spring action in order to allow the passage of the tongue through the passage slot so that it can be subsequently locked in.

As can be gathered from FIG. 4 on the side of the insulator directed towards the hotplate is provided a groove 54, which over a certain depth cuts through the sidewalls of the passage slot. In said groove 54 engage support parts 55 in the form of sheet metal tabs, which are formed on or by the step between the portions 36 and 37. The dimensions are such that the support parts 55 then engage on the bottom of the groove when the tongue 38 has been locked in. This high-speed connection is brought about by mere engagement, is automatically resiliently fixed and brings about a reliable guidance of the insulator in all lateral directions and in the rotary direction. For the mounting of the insulator 47 guiding the leads it is consequently only necessary to slightly downwardly bend the leads 24 out of their transport position and to move the insulator 47 axially above the same and simultaneously on the metal sideplate until it locks.

The high-speed connection can also be formed by other, preferably resilient locking elements, e.g. a fork-like construction of the sideplate with front barb-like locking elements, the fork being guided in lateral grooves of an insulator and locking in from the side. However, the present high-speed connection can be fitted particularly easily and reliably.

FIGS. 2 and 3 show an electric hotplate fitted in a sheet metal trim plate 40. FIG. 5 shows the same electric hotplate after its installation in a hard glass hob, in which the trim plate **40*a* is formed by a glass plate, in whose opening 41 is installed the hotplate 11 by means of an intermediate ring 60, an elastic sealing and support ring 61 and a shielding and centring ring 62. The glass plate 40*a* rests on a sheet metal supporting disk 63, on which is supported the clamp 43, which has a cutout 64** for the hotplate connection.

Thus, in the case of an otherwise identical construction of the connecting parts, the sideplate 33 also makes it possible to carry out the connection here, although the hotplate is installed higher due to parts 60 and 61 required for thermal insulation and sealing reasons and said parts also have a greater construction depth.

Thus, the sideplate can be downwardly pivoted about a horizontal axis by means of a desired bending point 65 (see also FIG. 3), the horizontal axis being as close as possible to the fixture of the sideplate to the lowest hotplate cover, i.e. at the transition between the T-beam 34 and the centre leg 36, 37. In the embodiment the desired bending point is formed by a central slot-like cutout 66 in the metal sheeting, which only leaves behind two marginal webs, which allow bending to take place without impairing the lateral stiffness.

Thus, in the case of FIG. 5, during the installation of the sideplate, before or after the snapping on of the insulator 47, the leads 24 are bent downwards. This is readily possible due to the axial mobility of the leads in the passage openings 48. They are laterally displaced due to the parallelogram arrangement of the sideplate and lead during pivoting. The hotplate can be laterally pivoted into the opening. It would fundamentally also be possible to bend the complete connection down so far that the hotplate can be inserted vertically from above and then the entire connecting unit is bent back again. It is nevertheless ensured that there is no contact between live parts and other hotplate parts.

FIG. 6 shows a construction with a sheet metal trim plate 40, in which with an otherwise identical construction of all the parts, the insulator 47 has a forwardly directed sleeve-like part 68 surrounding the flat connecting tongues. In FIGS. 2 to 5 the tongue projects freely out of the insulator 47, whereas here the part 68 embraces the said tongues 44 and plugs 45.

Figures 7, 8, 9, 10, 11, 12:
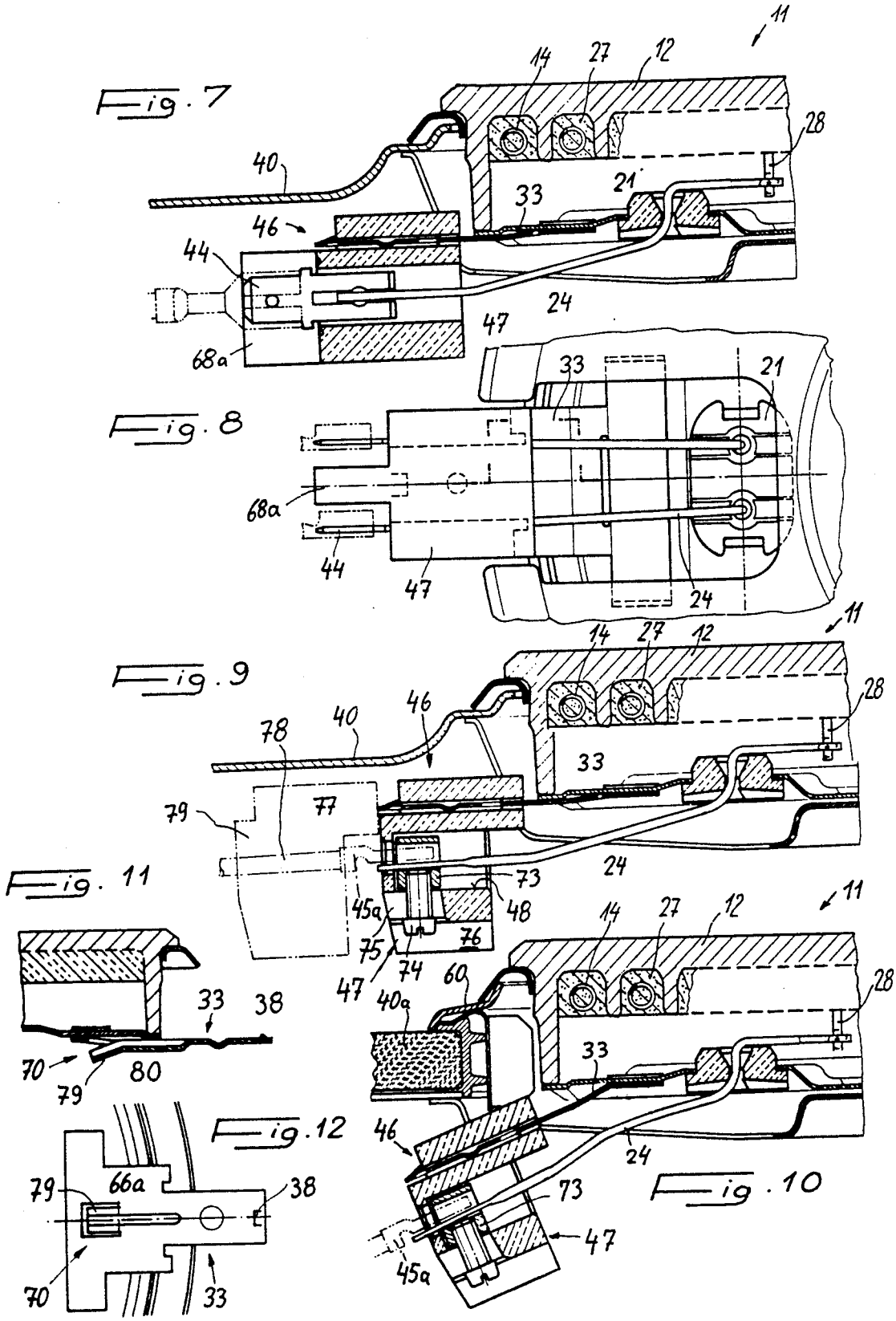

FIG. 6 shows that the sideplate 33 is provided in the vicinity of the desired bending point with pivoting limiting means 70, which are formed in that on either side of the webs forming the desired bending point are provided downwardly directed stampings 71 in the sideplate 33, which define a groove 72 in the vicinity of the desired bending point (cf. also FIG. 8). The side walls of the said grooves 72 formed by the stamping 71 move downwards towards one another on bending down the sideplate and finally engage on one another, so that they limit pivoting to a maximum angle. This prevents unintentional overpivoting into a position where the leads 24 could e.g. come into contact with the clamp 43.

FIGS. 7 and 8 show a construction, in which with an otherwise identical construction to FIG. 6, in place of the part 68 surrounding the plug connection 44, 45, there is a central, partition-like projection 68*a*. As in FIG. 6, here again there is a reciprocal insulation of the two hotplate connections, particularly against unintentional bending together of the two plugs 45. Whereas in FIG. 6 there is also an insulation to the outside, FIG. 7 is intended for those cases where this is not necessary.

For an otherwise identical construction of the hotplate 11 with sideplates 33 and trim plate 40, FIG. 9 shows a modified connection. In place of a plug connection with flat connecting tongues, in this case the leads 24 are only provided with a flat pressing at the end thereof and for an identical construction of the plug connection 46, the insulator 47 has in the vicinity of its passage openings 48 screw terminals 73, which comprise a metal sleeve and a connecting screw 74 screwed into the latter and which project downwards through an opening 75. An insulating rib 76 is provided between the screw heads. The screw simultaneously secures the terminal 73 in the insulator. On the side remote from the hotplate the passage opening 48 is constricted and a multicore cable end 45*a* of a supply line 78 can be passed through the insertion opening 77 formed.

The supply line 78 and their ends 45*a* can, as indicated in dot-dash line form, be guided in a connecting block 79, so as to facilitate insertion and form a substantially closed connecting unit in the assembled state.

FIG. 10 shows a hotplate and connecting parts according to FIG. 9 installed in a hard glass hob with the fitting parts according to FIG. 5. It can be seen that here again the entire connecting unit can be pivoted far downwards. As here the screw connection only takes place after installation, the necessary length compensation in the connecting area causes no problems, because the screw-type terminal engages on the corresponding point of the lead 24. To a certain extent this also secures the inclined position.

As in the other constructions, the insulator 47 can be supported by its upper surface on the mounting parts from below. Thus, the connection is held in position and short-circuits are avoided.

FIGS. 11 and 12 show a construction of the pivoting limiting means 70 for a sideplate 33. In place of the cutout 66 the weakening of the material forming the desired bending point 65 is here formed by a U-shaped cutout 66*a*, whose central member 79 together with the connecting part of the sideplate 33 is reinforced by a corrugation, the member 79 being bent downwards. On pivoting, in the intended limiting position, the reinforced member 79 engages on the cover 18 and consequently limits the pivoting movement.

I claim:

1. An electric hotplate having a cooking surface defining a cooking surface plane, connecting leads leading from the hotplate to insulator means, the insulator means being fixed by a connecting element to the hotplate, wherein quick connecting means are provided between the insulator means and the connecting element, said connecting element being a sheet metal plate fixed to a lower hotplate cover, said plate defining a plate plane substantially parallel to the cooking surface plane, said plate projecting past an outer circumference of said hotplate.

2. A hotplate according to claim 1, wherein the quick connecting means contain a snap coupling.

3. A hotplate according to claim 1, wherein the quick connecting means contain a plug-in coupling.

4. A hotplate according to claim 1, wherein the insulator means further having a slot, into which slot the connecting element can be inserted.

5. A hotplate according to claim 1, wherein the quick connecting means are effective against drawing-off the insulator means from the hotplate, a stop being provided to prevent movement in the opposite direction to said drawing-off direction.

6. A hotplate according to claim 1, wherein the leads project into passage openings of the insulator means.

7. A hotplate according to claim 1, wherein in the vicinity of the insulator means electrical connection means are provided between the leads and hotplate supply lines.

8. A hotplate according to claim 7, wherein the electrical connection means being plug connections, which are partly located in passage openings of the connecting means and are movable along the connecting means.

9. An electric hotplate with connecting leads leading from the hotplate to insulator means, the insulator means being fitted by a connecting element to the hotplate wherein quick connecting means are provided between the insulator means and the connecting element, said quick connecting means having barb-like locking means on the connecting element, which connecting element is constructed as a sheet metal plate.

10. An electric hotplate with connecting leads leading from the hotplate to insulator means, the insulator means being fitted by a connecting element to the hotplate wherein quick connecting means are provided between the insulator means and the connecting element, said quick connecting means being effective against drawing-off the insulator means from the hotplate in a drawing-off direction, a stop being provided to prevent movement in the opposite direction to said drawing-off direction, said stop including knife-edge bearing means on the connecting element, cooperating with a recess of the insulator means.

11. An electric hotplate with connecting leads leading from the hotplate to insulator means, the insulator means being fitted by a connecting element to the hotplate wherein quick connecting means are provided between the insulator means and the connecting element, the connecting element being fitted pivotably to the hotplate in one direction, its pivoting axis being substantially parallel to a cooking surface of the hotplate and substantially at right angles to the connecting leads.

12. A hotplate according to claim 11, wherein the connecting element is only pivotable in said one pivoting direction.

13. A hotplate according to claim 11, wherein pivoting limiting means are provided and limit pivoting of the connecting element to an angle of under 45° to the horizontal.

14. A hotplate according to claim 13, wherein the connecting element has stiffening means of a group containing corrugations, which cooperate with the pivoting limiting means.

15. An electric hotplate with connecting leads leading from the hotplate to insulator means, the insulator means being fitted by a connecting element to the hotplate wherein quick connecting means are provided between the insulator means and the connecting element, the connecting element being a sheet metal plate cover fixed to a lower hotplate, said plate having a predetermined bending area, the bending area being located between a bushing for guiding the leads through the cover and the insulator means.

16. A hotplate according to claim 15, wherein the bending area being situated closer to the bushing than to the insulator means.

* * * * *